United States Patent [19]

Koizumi

[11] 4,348,098

[45] Sep. 7, 1982

[54] ELECTROPHOTOGRAPHIC APPARATUS

[75] Inventor: Yutaka Koizumi, Kawasaki, Japan

[73] Assignee: Ricoh Company, Ltd., Tokyo, Japan

[21] Appl. No.: 147,048

[22] Filed: May 6, 1980

[30] Foreign Application Priority Data

May 7, 1979 [JP] Japan ..... 54/55427

[51] Int. Cl.[3] ..... G03G 15/00

[52] U.S. Cl. ..... 355/3 TR; 355/3 TE; 355/14 TR; 355/14 CH; 430/126; 118/621

[58] Field of Search ..... 355/3 TR, 3 FU, 3 SH, 355/3 CH, 3 TE, 3 DR, 14 TR, 14 FU, 14 CH, 14 SH; 427/14.1; 346/153, 155; 430/126; 118/621

[56] References Cited

U.S. PATENT DOCUMENTS

| | | | |
|---|---|---|---|
| 3,441,938 | 4/1969 | Markgraf | 346/153.1 X |
| 3,493,501 | 2/1976 | Root | 355/3 FU X |
| 3,620,616 | 11/1971 | Davidson | 355/3 TR |
| 3,701,996 | 10/1972 | Perley | 346/153.1 |
| 4,055,380 | 10/1977 | Borostyan | 355/3 TR |
| 4,068,588 | 1/1978 | Nakano et al. | 355/3 TE X |
| 4,165,171 | 8/1979 | Lemmen | 355/3 TR X |
| 4,172,905 | 10/1979 | Metcalfe et al. | 355/3 TR X |
| 4,195,927 | 4/1980 | Fotland et al. | 355/3 TR X |
| 4,205,912 | 6/1980 | Yamaguchi et al. | 355/3 TR X |
| 4,207,101 | 6/1980 | Vola et al. | 355/3 TR X |

*Primary Examiner*—J. V. Truhe
*Assistant Examiner*—Richard M. Moose
*Attorney, Agent, or Firm*—Wyatt, Gerber, Shoup, Scobey & Badie

[57] ABSTRACT

An electrophotographic apparatus is provided in which a toner image formed on a photosensitive member is initially transferred onto the surface of a transfer roller and then transferred onto a transfer sheet. Before the transfer step takes place, charge is injected into the toner image on the photosensitive member and the transfer roller is disposed close to the surface of the photosensitive member with a very small clearance. The photosensitive member has a conductive layer to which a bias voltage of the same polarity as the polarity of the toner charge can be applied. The transfer sheet is fed into the nib between the transfer roller and its abutting fixing roller, whereby the transfer and fixing of the toner image take place simultaneously.

7 Claims, 2 Drawing Figures

ELECTROPHOTOGRAPHIC APPARATUS

BACKGROUND OF THE INVENTION

The invention relates to an electrophotographic apparatus in which a toner image formed on a photosensitive member as a result of developing a latent image is transferred onto a transfer sheet and fixed thereon to provide a copy.

One transfer and fixing technique used in such an electrophotographic apparatus comprises the steps of disposing a transfer sheet in superimposed relationship with a toner image on a photosensitive member, effecting a corona discharge of the opposite polarity from that of the toner from behind the transfer sheet to transfer the toner image onto the sheet, and fixing the transferred toner image on the sheet under heat and/or pressure. Another technique comprises the steps of disposing a transfer sheet in superimposed relationship with the toner image on the photosensitive member, applying a member such as a roller which is electrically energized to the opposite polarity from that of the toner to the rear surface of the sheet to effect the transfer of the toner image onto the sheet, and fixing the transferred toner image to the sheet under heat and/or pressure. However, these techniques, though extensively used in conventional electrophotographic apparatus, suffer from the susceptibility of the surface of the photosensitive member to damage since the transfer sheet is directly brought into contact with the surface when transferring the toner image onto the sheet. Also, the surface of the photosensitive member may be subject to damage as a result of a jamming of the sheet which may become entangled with a transfer charger. In addition, the separation of the transfer sheet from the surface of the photosensitive member relies on the use of electrostatic means such as a.c. corona discharge or mechanical means such as claws or separator belt, both of which leaves much to be improved, since they give rise to the likelihood that the transfer sheet may be jammed or entangled to the photosensitive member. When separating the transfer sheet from the photosensitive member, the transferred toner image may be disrupted or may be partly lost, or a non-uniformity may occur in the effect of the transfer. As an alternative, a toner image on the photosensitive member may be temporarily transferred onto an intermediate transfer material, from which the toner image may again be transferred onto a transfer sheet under heat and/or pressure, as exemplified in U.S. Pat. No. 3,951,276. However, such technique suffers from the quality of the transfer which remains unsatisfactory.

SUMMARY OF THE INVENTION

It is a feature of the invention that charge is injected into a toner image which is formed on a photosensitive member by a developing step, before the toner image is transferred onto a conductive transfer roller which is brought to the vicinity thereof. The charge injection increases a potential difference between the toner and the transfer roller as compared with the magnitude of the potential difference between the photosensitive member and the toner, so that the resulting electric field facilitates a transfer of the toner onto the transfer roller. Another feature of the invention is the disposition of a fixing roller in abutting relationship with the transfer roller, and a transfer sheet is fed into the nib therebetween to transfer the toner image from the transfer roller onto the transfer sheet and to fix it on the latter.

In this manner, the transfer, the separation and the fixing are achieved by using the pair of rollers in accordance with the invention, and hence there is provided an apparatus which is simple in construction, small in size, durable and inexpensive. In addition, the reliability in operating the apparatus and passing the sheet is greatly improved, enabling the transfer, separation and fixing steps to be performed at a higher rate. Since the fixing step is achieved by the application of a pressure rather than utilizing a thermal fixing, the warm-up time which is usually required can be reduced to zero.

Therefore it is an object of the invention to provide an electrophotographic apparatus which is provided with an improved transfer and fixing unit.

It is another object of the invention to provide an electrophotographic apparatus which is provided with the described unit which is simple in construction, small in size, durable and inexpensive.

It is a further object of the invention to provide an electrophotographic apparatus of the kind described which has a high reliability, permitting a high speed transfer, separation and fixing operation.

Other objects and features of the invention will be apparent from the following description with reference to the drawings.

DESCRIPTION OF PREFERRED EMBODIMENT

Figure 1:
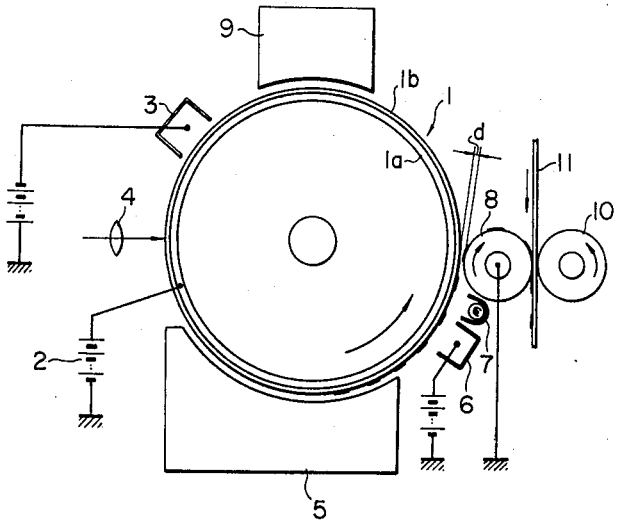
FIG. 1 is a schematic view illustrating the principle of operation of an electrophotographic apparatus according to the invention.

Referring to FIG. 1, there is shown a photosensitive member in the form of a drum 1 having a conductive layer 1*a* which is in turn covered with a photoconductive, insulating layer 1*b*. The conductive layer 1*a* is connected to a bias source 2, but it should be understood that such connection may be omitted. As shown, the drum 1 is adapted to rotate counterclockwise, and disposed around the drum are a corona charger 3 which is used to charge the insulating layer 1*b*, an exposure optical system 4, a developing unit 5, a corona charger 6 which is used in accordance with the invention to perform the injection of charge, a flash exposure lamp 7, a conductive transfer roller 8 and a cleaning unit 9, in the sequence named, as viewed in the direction of rotation of the drum. The polarity of a voltage which is applied to the corona charger depends on the nature of the photoconductive insulating layer on the drum used, but it is assumed to be negative in the description to follow. Then, a positive voltage is applied to the conductive layer 1*a* of the photosensitive member and the charge injecting corona charger 6. The toner used is charged to the positive polarity.

In operation, the drum surface is uniformly charged to the negative polarity by the corona charger 3, and is then irradiated with light image of an original to be copied which is projected through the exposure optical system 4. Thereupon, the charge on the drum surface is selectively erased, forming an electrostatic latent image thereon which corresponds to the image of the original. The latent image which is formed to the negative polarity is developed by a toner supplied from the developing unit 5 and which is charged to the positive polarity, thus producing a toner image of the positive polarity which is maintained on the drum surface. The toner image is charged to a more positive potential by the charge injecting charger 6 until a relative potential difference of substantially zero is reached between the toner image and the drum to which a positive bias voltage is applied. Subsequently, the entire drum surface is irradiated by the flash exposure lamp 7 whereupon the negative charge which maintains the toner in place is caused to be discharged, facilitating a release of the toner from the drum surface. However, it should be understood that the irradiation with light is not always necessary and if it is effected, it may occur simultaneously with the corona discharge by the charger 6 which is then constructed to provide an open top. As the drum further rotates, the toner image is carried to a position corresponding to the transfer roller 8 which is formed by a metal roller and is connected to ground. The transfer roller 8 is closely spaced from the drum surface with a very small clearance d on the order of 20–300 $\mu$m, and is driven to rotate at the same peripheral speed and in the same direction as the drum surface at the point where they are nearest each other. Since additional charge is injected or supplied by the charger 6 into the toner image on the drum to reduce a potential difference between the toner image and the drum, the potential difference between the toner image and the transfer roller which is connected to ground prevails, and the resulting electric field effects a transfer of the toner image onto the transfer roller. Though a sufficient potential difference is obtained if the transfer roller 8 is connected to the ground, the potential difference can be further increased by applying a bias voltage of the opposite polarity from that of the toner image. A fixing roller 10 is disposed in abutting relationship with the transfer roller, and rotates in the same direction and at the same speed as the latter at their point of contact. It is preferred that the fixing roller 10 be urged against the transfer roller with a pressure which is equal to or greater than 10 kg/cm$^2$. As the transfer sheet 11 is fed into the nib between the transfer roller 8 and the fixing roller 10, the toner image on the transfer roller is transferred onto the transfer sheet and fixed thereon as in a usual pressure fixing process. A transfer rate of approximately 100% can be expected. The material for the fixing roller 10 may be suitably chosen provided a required pressure is assured.

Figure 2:
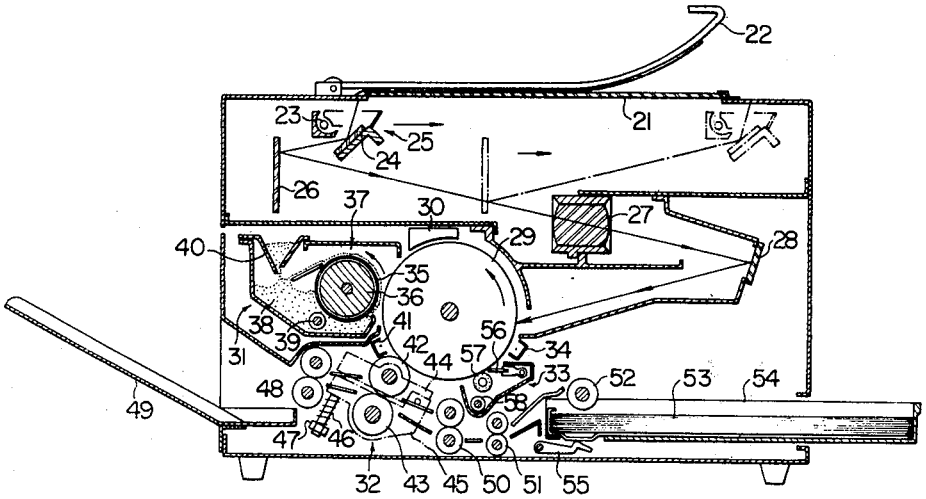
FIG. 2 is a schematic front view of one embodiment of the electrophotographic apparatus according to the invention.

FIG. 2 shows one embodiment of the electrophotographic apparatus according to the invention. A transparent glass pane 21 which defines a receptacle to place an original thereon is disposed on the top of the apparatus, and an opaque original cover 22 is placed over the glass pane with its one end fixedly carried by a stationary part of the apparatus so that its other end can be raised and lowered. Disposed within the apparatus are a first reflecting mirror unit 25 which includes an exposure lamp 23 and a first reflecting mirror 24, and a second reflecting mirror 26, both of which are disposed to be reciprocable in the horizontal direction from their left-hand home positions shown in the figure. The first reflecting mirror unit 25 is adapted to move to the right with a speed V while the second reflecting mirror 26 is adapted to move in the same direction with a speed V/2. A focusing lens 27 and a third reflecting mirror 28 are disposed stationarily below these elements and have an optical relationship therewith. A photosensitive member in the form of drum 29 is centrally disposed in the interior of the apparatus so as to be rotatable in the counterclockwise direction with a peripheral speed V. An image retouch unit 30, a developing unit 31, a transfer and fixing unit 32 which is constructed in accordance with the invention, a cleaning unit 33, a corona charger 34 which is used to charge the drum are sequentially disposed around the drum, as viewed in the direction of rotation thereof beginning from the top position. The image retouch unit 30 may comprise a charge neutralizer lamp which erases an electric charge from an area other than an image region.

The developing unit 31 is shown as a conventional developing unit of magnetic brush type which includes a developing roller 37 having a rotatable non-magnetic sleeve 35 within which a stationary magnet 36 is disposed, and an impeller 39 which serves agitate a toner and a carrier of a two-component developer 38. A toner replenishing unit 40 is associated with the developing unit 31. However, it should be understood that any developing unit of either a dry or a wet type may be used to carry out the invention provided the developer used permits fixing by pressure.

The transfer and fixing unit 32 of the invention comprises a charge injecting charger 41, a transfer roller 42 and a fixing roller 43. The transfer roller 42 is carried by a holder 44 which is pivotally connected with another holder 45 which in turn carries the fixing roller 43. One end of the holders are clamped together by using a bolt and a nut, as indicated at 47, with a spring 46 interposed therebetween to maintain both rollers in abutting relationship. The unit 32 is positioned so that a very small clearance is maintained between the transfer roller and the drum surface. A pair of pull-out rollers 48 are disposed to the left of the pair of transfer and fixing rollers to enable a sheet to be delivered onto a tray 49 which is disposed to the left of the pull-out rollers. A pair of paper feed register rollers 50 are disposed to the right of the pair of transfer and fixing rollers and serve to feed a sheet in proper synchronization, and a pair of transfer sheet conveyor rollers 51 are disposed to the right of the pair of rollers 50. A feed paper cassette 54 containing a supply of transfer sheets 53 is disposed to the right of the conveyor rollers 51, and a feed roller 52 is disposed above the cassette at the left-hand end thereof. In response to a command, a lever 55 disposed in the bottom of the cassette is driven upward to bring an uppermost one of the transfer sheets into contact with the rotating feed roller 52, which then feeds that sheet by a frictional resistance produced therebetween.

The cleaning unit 33 is a conventional one used in a copying machine of a dry type, and includes a rubber blade 56 having its free end disposed in abutment against the drum surface, a foam roller 57 which is disposed in abutment against the drum surface for rotation, and a rotatable auger 58 which is used to carry out a removed toner. Where a liquid developer is used, the cleaning unit 33 as well as the developing unit 31 are modified in a corresponding manner.

In operation, as the drum 29 begins to rotate, its surface is uniformly charged by the corona charger 34. Light image of an original placed on the glass pane 21 is projected through the exposure optical system, forming a latent image which corresponds to the image of the original thereon. Subsequently, the latent image is developed by the developing unit 31 after it is subject to the action of the image retouch unit as required. The charger 41 then operates to charge the developed toner image to a higher potential, thus reducing the magnitude of a potential difference between the toner image and the bias potential which is applied to the conductive layer of the drum. In this manner, release of the toner image from the drum surface is facilitated. As the toner image approaches the transfer roller 42 which is connected to ground or to which a bias voltage of the opposite polarity is applied, the resulting electric field created therebetween causes the toner image to be transferred onto the transfer roller inasmuch as the latter is located very close to the drum. It is to be noted that the transfer roller rotates with the same peripheral speed as the drum. The toner image transferred onto the roller is then transferred onto a transfer sheet 53, which is fed into the nib between the transfer roller 41 and the fixing roller 43. Since the fixing roller 43 rotates while abutting against the transfer roller, the toner image is sequentially fixed under pressure. Subsequently, the transfer sheet is carried through the pull-out rollers 48 and delivered onto the tray 49. On the other hand, a residual toner on the drum surface is cleaned by the cleaning unit 33 and the removed toner may be fed to the developing unit 31 for re-use, as required.

As discussed, the transfer and fixing unit according to the invention is applicable to any copying machine of either dry or wet type and employing a photosensitive member which may be belt- or web-shaped in addition to a drum configuration.

It will be appreciated that according to the invention, one pair of rollers effectively achieves the three functions of the transfer, separation and fixing. In this manner, a high speed operation is enabled. Since the construction is very simple, it can be constructed in a compact manner, enabling a reduction in the cost. Because no intermediate transfer member in the form of a belt which represents a disposable member is used, the unit has a high durability. A transfer sheet can be passed through the apparatus with an increased reliability. Since no heat is utilized in the fixing step, a saving can be achieved in the power dissipation. In addition, there is no need to maintain the apparatus in the pre-heated condition, eliminating any warm-up time, and enabling a copy to be obtained immediately after a main switch is turned on. Since no special separation means is required, it is unnecessary to provide a marginal area for the transfer sheet, which rather may be entirely formed with a transferred image.

While the invention has been disclosed in conjunction with a specific embodiment, it will be evident that many alternatives, modifications and changes can be made in the disclosed arrangement by those skilled in the art in light of the foregoing description. Accordingly, it is intended to embrace all such alternatives, modifications and changes as fall within the spirit and broad scope of the appended claims.

What is claimed is:

1. In an electrophotographic apparatus comprising a photosensitive member movable passed a plurality of processing stations to form an electrostatic latent image on said member and having means for developing said electrostatic latent image to form a toner image by contacting said latent image with a charged toner, the improvement including transfer means for transferring said toner image onto a record surface without physically contacting said photosensitive member, said transfer means including a conductive transfer roller disposed in closely spaced relation with said photosensitive member, means for making the potential difference between the toner of said toner image on said photosensitive member and said conductive transfer roller larger than the potential difference between said toner and said photosensitive surface by injecting charge into said toner whereby said toner image can be transferred to said conductive transfer roller as said photosensitive surface moves closely therepassed, and removing means for transferring the toner image on said conductive transfer roller to a record surface.

2. An electrophotographic apparatus according to claim 1, said removing means including a fixing roller disposed in abutting relationship with said conductive transfer roller to form a nip therebetween receiving a record sheet, said fixing roller being held against said conductive transfer roller with sufficient force so as to fix said toner image to said record sheet by pressure.

3. An electrophotographic apparatus according to claim 1, said conductive transfer roller being spaced from about 20 $\mu$m to about 300 $\mu$m from said photosensitive surface.

4. An electrophotographic apparatus according to either claim 1 or claim 2, further including means effecting a flash irradiation of said photosensitive member simultaneously with or subsequent to the injection of charge into said toner.

5. An electrophotographic apparatus according to either claim 1 or 2, said conductive transfer roller being electrically grounded.

6. An electrophotographic apparatus according to either claim 1 or 2, said conductive transfer roller receiving a bias voltage of a polarity opposite that of said toner.

7. An electrophotographic apparatus according to either claim 1 or 2, said photosensitive surface including a conductive inner layer receiving a bias voltage of the same polarity as said toner.

* * * * *